US006472606B2

(12) United States Patent
Yamakawa et al.

(10) Patent No.: US 6,472,606 B2
(45) Date of Patent: Oct. 29, 2002

(54) ELECTRICAL CONNECTION BOX

(75) Inventors: Shuji Yamakawa, Yokkaichi (JP); Eriko Yuasa, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 10/025,654

(22) Filed: Dec. 26, 2001

(65) Prior Publication Data

US 2002/0084102 A1 Jul. 4, 2002

(30) Foreign Application Priority Data

Dec. 28, 2000 (JP) ..... 2000-402068

(51) Int. Cl.[7] ..... H01B 17/00; H01R 9/00
(52) U.S. Cl. ..... 174/149 B; 439/76.2; 439/949
(58) Field of Search ..... 439/949, 76.1, 439/76.2; 174/68.2, 70 B, 71 B, 72 B, 88 B, 99 B, 149 B

(56) References Cited

U.S. PATENT DOCUMENTS 5,866,850 A * 2/1999 Kobayashi ..... 174/70 B
5,877,944 A * 3/1999 Onizuka ..... 439/76.2
6,179,628 B1 * 1/2001 Hasegawa et al. ..... 439/949
6,224,397 B1 * 5/2001 Nakamura ..... 439/76.2
6,244,876 B1 * 6/2001 Saka ..... 439/76.2
6,261,105 B1 * 7/2001 Uezono ..... 439/76.1
6,270,359 B1 * 8/2001 Kondo et al. ..... 439/76.2
6,270,361 B1 * 8/2001 Onizuka et al. ..... 439/76.2
6,309,226 B1 * 10/2001 Nakatani ..... 439/76.2
6,310,293 B1 * 10/2001 Kawakita ..... 174/68.2
6,325,642 B2 * 12/2001 Asao ..... 439/76.2
6,379,195 B1 * 4/2002 Torikoshi et al. ..... 439/949
6,402,569 B1 * 6/2002 Spadoni et al. ..... 439/949
6,409,522 B1 * 6/2002 Onizuka ..... 439/949

FOREIGN PATENT DOCUMENTS

JP U 63-81616 5/1988

* cited by examiner

*Primary Examiner*—Dean A. Reichard
*Assistant Examiner*—Adolfo Nino
(74) *Attorney, Agent, or Firm*—Oliff & Berridge, PLC

(57) ABSTRACT

An electrical connection box for a vehicle has bus bars providing terminals which stand up close to each other, and an insulation plate through which the terminals project. A case member covering the insulation plate provides housing spaces for the terminals. A partitioning wall of the casing separating the housing spaces contacts the upper end of an upstanding wall of the insulation plate. One of the partitioning walls and the upstanding walls has a recess and the other has a projection received in the recess. This prevents liquid passage from one housing space to the other, and minimizes risk of current leak between terminals.

15 Claims, 5 Drawing Sheets

ELECTRICAL CONNECTION BOX

BACKGROUND OF THE INVENTION

1. Field of Invention

The present invention relates to an electrical connection box suitable to be mounted on an industrial product such as a vehicle or a robot, and more particularly an electrical connection box accommodating bus bars having terminals for connection to another component such as a relay.

2. Description of Related Art

Electric and electronic parts for a vehicle are mounted in a vehicle body by accommodating them in an electrical connection box. JP-A-63-81616 shows an example of a known electrical connection box having an insulation plate carrying bus bars. Terminals are formed by bending the bus bars so that end portions extend upward, and engage relay terminals. A cover member overlies the insulation plate and has apertures through which connection can be made to the relay terminals. The insulation plate has upstanding walls between the terminals to provide some insulation between them, so that the terminals may be close to each other. However, if water or the like penetrates into the space containing the terminals, there is insufficient insulation, so that there is a risk that a current leak may occur between the terminals 56*a*, 56*b*.

SUMMARY OF THE INVENTION

Accordingly, it is an object of the present invention to provide an electrical connection box capable of preventing or minimizing risk of a current leak due to penetration of water or the like into the box.

According to the invention there is provided an electrical connection box having

- a plurality of bus bars providing at least two terminals which stand up close to each other,
- an insulation plate overlying the bus bars and having respective apertures through which the terminals project and further having at least one upstanding wall adjacent the apertures and having an upper end,
- a case member covering the insulation plate and having walls providing respective housing spaces for the terminals including a partitioning wall separating an adjacent pair of housing spaces,
- wherein the partitioning wall has a lower end in contact with the upper end of the upstanding wall and one lower end of the partitioning wall and the upper end of the upstanding wall has a recess and the other thereof has a projection received in the recess.

Preferably, the recess is an elongate groove of tapering cross-section and the projection is an elongate ridge of tapering cross-section. In this case, the groove is preferably at the upper end of the upstanding wall. The base of the groove may be inclined horizontally along the groove.

Alternatively, the recess is on the lower end of the partitioning wall and the projection is on the upper end of the upstanding wall.

In the invention, when the insulating plate and the case member are combined with each other, the upstanding wall of the plate contacts the lower end of the partitioning wall which separates the terminals from each other. The recess formed on the upper end surface of the upstanding wall or on the lower end surface of the partitioning wall receives the corresponding projection. Therefore, compared with a case where the upper end of the upstanding wall or the lower end of the partitioning wall is flat, the terminals are separated by an elongate path. Thus, even though water or the like penetrates into the terminal spaces and into a gap between the upstanding wall and the partitioning wall, it is possible to minimize the risk of a current leak occurring between the terminals.

Preferably, the recess is a groove formed on the upper end of the upstanding wall. Thus, even though water or the like penetrates into the gap between the upstanding wall and the partitioning wall, the water collects in the groove. Further, the groove may have an inclination, so that the water flows to the outside. This further reduces the risk of a current leak.

Alternatively, the projection is formed on the upper end of the upstanding wall. Therefore, even though water or the like penetrates into a gap between the partitioning wall and the upstanding wall, the projection prevents flow of the water through the gap. Thus, it is difficult for the water or the like to penetrate the gap between the partitioning wall and the upstanding wall. Thus, the risk of current leak is also minimized.

The invention further provides an industrial product, such as a vehicle or a robot, having such an electrical connection box mounted on it.

BRIEF DESCRIPTION OF THE DRAWINGS

Embodiments of the invention will now be described by way of non-limitative example with reference to the drawings, in which.

DETAILED DESCRIPTION OF PREFERRED EMBODIMENTS

The electrical connection box of FIGS. 1 to 4, which is intended for a vehicle such as an automobile, has a circuit member 12 containing bus bars in layers and a molded plastic case 14, which is part of a casing of the box.

Figure 3:
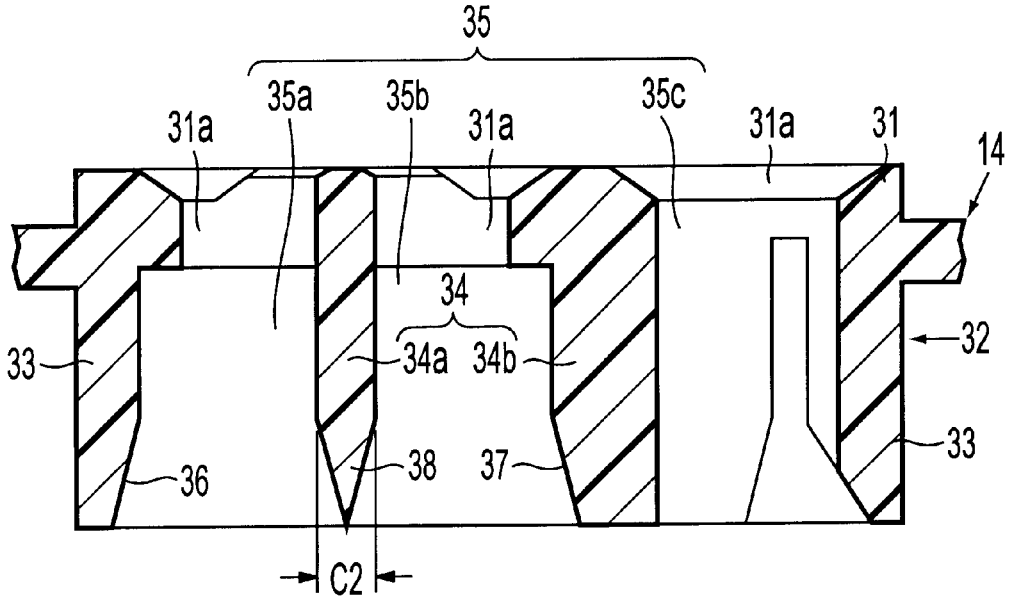
FIG. 3 is a sectional view on line A—A of FIG. 1.
Figure 3:
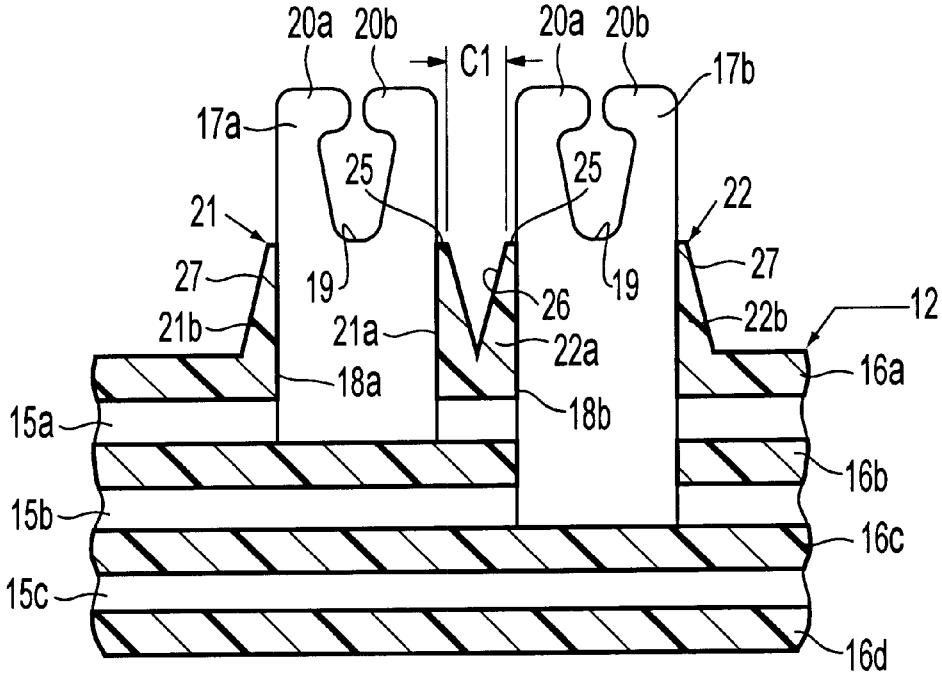
Figure 4:
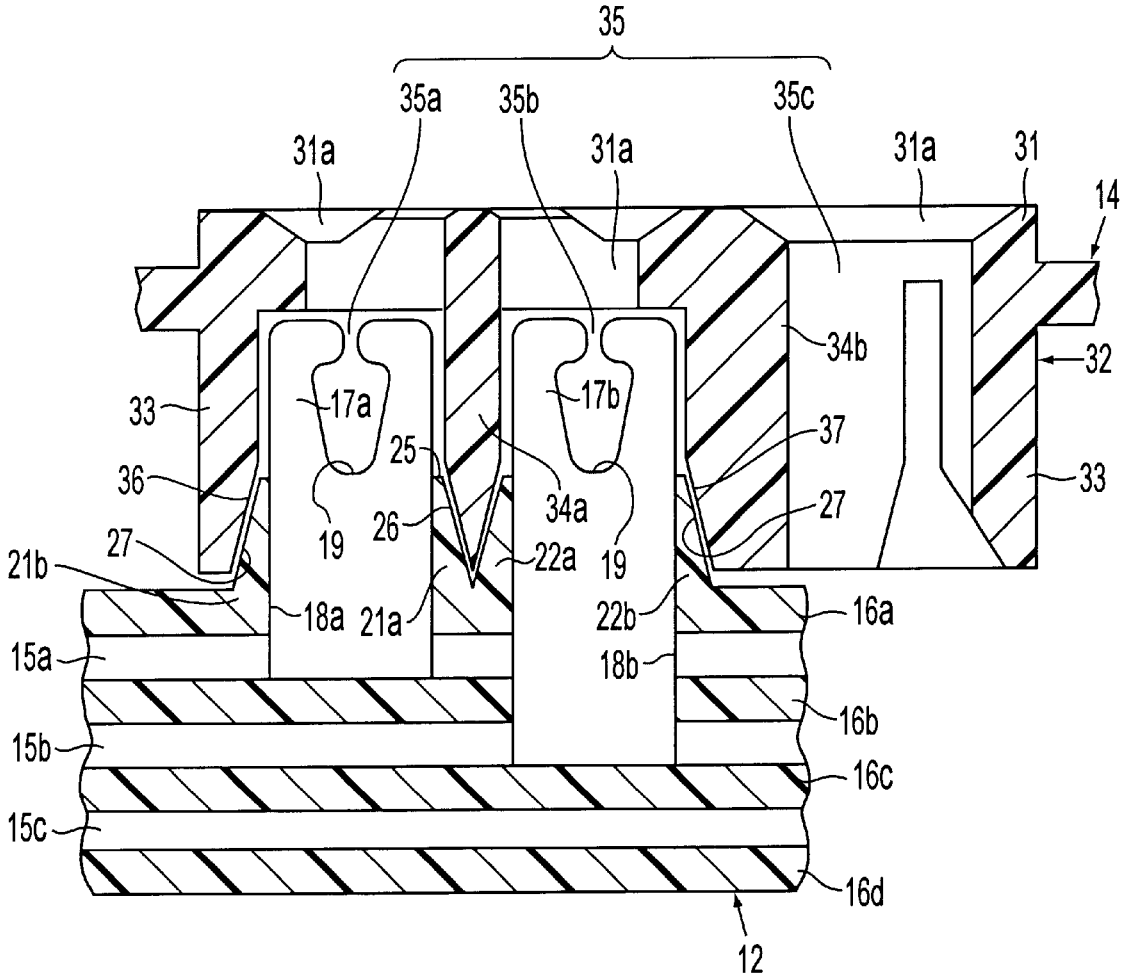
FIG. 4 is a sectional view showing a stack member and a case have been combined with each other.

As shown in FIGS. 3 and 4, the circuit member 12 is constructed of a plurality (three in the embodiment) of layers of bus bars 15*a*–15*c* and a plurality (four in the embodiment) of insulating plates 16*a*–16*d* stacked one on another. The layers of bus bars 15*a*–15*c* are separated from each other by the insulating plates 16*a*–16*d*. The uppermost insulating plate 16*a* covers the upper surface of the uppermost bus bars 15*a*.

Terminals 17*a*–17*d* are formed by bending the bus bars 15*a*–15*c* so that they project upward through respective apertures 18*a*, 18*b* formed in the uppermost insulating plate 16*a*. The terminals 17*a*–17*d* project from the insulating plate 16*a*.

Each of the terminals 17*a*–17*d* has a downward notch 19 formed at the centre of its upper end with two inward projections 20*a*, 20*b* at the mouth of the notch. When a plate or the like is inserted into the notch 19, it is sandwiched between the inward projections 20*a*, 20*b* to establish a gripping connection. Adjacent terminals 17*a*, 17*b* and apertures 18*a*, 18*b* are formed at positions close to each other.

As shown in FIGS. 1 to 4, around each aperture 18*a*, 18*b* the plate 16*a* has walls 21–24 extending upwardly from the top surface of the plate 16 so as entirely to surround the respective terminals 17*a*–17*d*.

Figure 1:
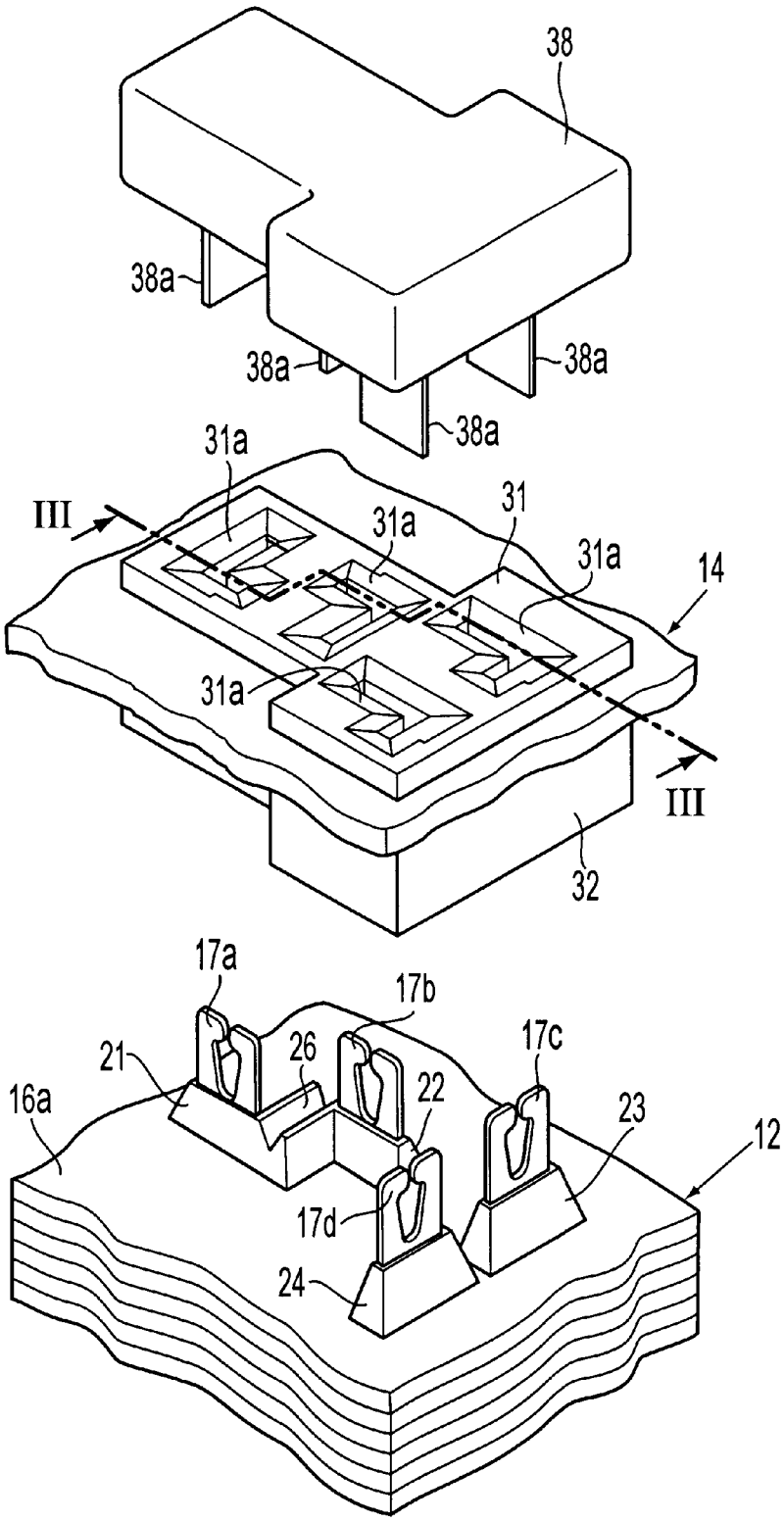
FIG. 1 is an exploded perspective view showing a part of an electrical connection box which is an embodiment of the present invention.
Figure 2:
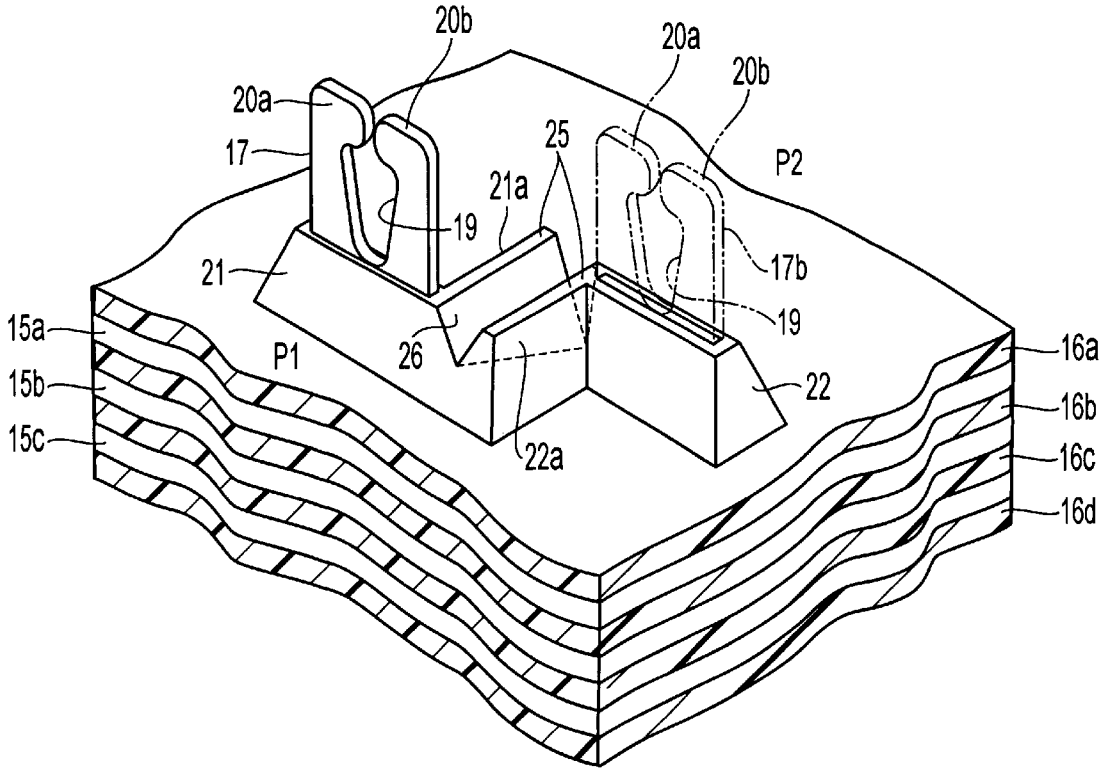
FIG. 2 is an enlarged perspective view of a portion of the electrical connection box of FIG. 1

As shown in FIGS. 1 and 2, the walls 21, 22 are in connection with each other at their sides and an upstanding wall construction is constituted by through side walls 21*a*, 22*a*. As shown in FIG. 3, the spacing C1 between the peaks 25 of the side walls 21*a*, 22*a* is almost equal to the thickness C2 of a partitioning wall 34*a* of the case 14 which will be described later. A groove 26 is formed downwardly between the peaks 25 of the side walls 21*a*, 22*a*. The groove 26 is V-shaped and extends in the longitudinal direction of the peaks 25, its base being inclined downwardly towards one end of the side walls 21*a*, 22*a* (see FIG. 2). In other words, the groove 26 is formed so that it becomes deeper towards the point P2 shown in FIG. 2 from the point P1 in FIG. 2. As shown in FIG. 3, inclined surfaces 27 are provided at the outer surface (left-hand side in FIG. 3) of the side wall portion 21*b* of the wall 21 and the outer surface (right-hand side in FIG. 3) of the side wall 22*b* of the wall 22.

As shown in FIG. 1, a zone 31 for installing an electric/electronic part is formed on the upper surface of the case 14. Through-holes 31*a* are formed at the zone 31 at positions corresponding to the respective terminals 17*a*–17*d*. As shown in FIG. 3, on the rear surface of the case 14, a terminal housing portion 32 is formed at the position corresponding to zone 31. The housing portion 32 has a downward outer side wall 33 surrounding all the terminals 17*a*–17*d* and downward partitioning walls 34 separating the terminals 17*a*–17*d* from each other. Thereby a plurality of spaces 35 are formed by the housing portion 32 which are shown in FIG. 4, when the circuit member 12 and the case 14 are combined, accommodate the terminals 17*a*–17*d* separately.

The partitioning wall 34*a* separating spaces 35*a*, 35*b*, which accommodates adjacent terminals 17*a*, 17*b*, tapers towards its lower end which is a pointed downward ridge 38 as seen in cross-section. When the circuit member 12 and the case 14 are combined, the wall 34*a* is inserted into the groove 26 between the side walls 21*a*, 21*b*.

An inclined surface 36 sloping outwardly toward its lower end is formed in the vicinity of the lower end of the inner surface of the outer side wall 33 of the housing portion 32, in correspondence to the inclined surface 27 of the wall 21. As shown in FIG. 4, when the circuit member 12 and the case 14 are combined these inclined surfaces 27, 36 contact. An inclined surface 37 sloping away from the aperture 18*b* towards the space 35*c* is formed in the vicinity of the lower end of the surface of a partitioning wall 34*b* facing the space 35*b*. The partitioning wall 34*b* partitions the space 35*b* and the space 35*c* containing the terminal 17*c* from each other. The inclined surface 37 is formed in correspondence to the inclined surface 27 of the wall 22. When the circuit member 12 and the case 14 are combined, the inclined surface 37 contacts the inclined surface 27.

In FIG. 4, to make the construction of the circuit member 12 and the case 14 clear, a slight gap is shown between the partitioning wall 34*a* and the side walls 21*a*, 21*b*, and similarly, a slight gap is shown between the pairs of inclined surfaces 27, 36 and 27, 37 but in practice these faces are intended to contact.

When the circuit member 12 and the case 14 are combined, an electric/electronic part 38 (a relay in the embodiment) is mounted on the installing zone 31. Connection terminals 38*a* of the part 38 are inserted into the corresponding through-holes 31*a* and fitted into terminals 17*a*–17*d* respectively to achieve electrical connection. In use, for example, the electrical connection box is mounted in a vehicle compartment. The case 14 may be combined with a lower case (not shown) to enclose the circuit member 12.

This embodiment provides the following effects:

(1) The walls 21–24 project up around the periphery of each terminal aperture of the uppermost insulating plate 16*a*. When the circuit member 12 and the case 14 are combined, the pointed lower end of the partitioning wall 34*a* separating two terminals 17*a*, 17*b* is inserted into the groove 26 between the side walls 21*a*, 22*a*. This elongates the path between the housing spaces 35*a*, 35*b*, compared with the case where the abutting faces are flat, so that even if water or the like penetrates into the housing portion 32, the possibility that a current leak will occur between the terminals 17*a*, 17*b* is reduced. The shape of the wall 34*a* and groove 26 minimizes penetration of water into the gap between the wall 34*a* and the side walls 21*a*, 22*a*.

In recent years, as more electric and electronic parts are mounted on a vehicle body, there is a tendency to adopt a battery voltage of 42V. Thus, prevention of the generation of current leakage is more critical.

The groove 26 is formed downward from the peaks 25 of the side walls 21*a*, 22*a* so that if water or the like penetrates into this location it collects in the groove 26. Further, because this groove has an inclination, water or the like collected in the groove 26 flows to outside along the inclined surface. This enhances protection against current leakage between the terminals 17*a*, 17*b*.

The inclined surface 36 sloping outward toward its lower end is formed in the vicinity of the lower end of the inner surface of the outer side wall 33 of the housing portion 32. Thus water or the like flowing from above along the inner surface of the outer side wall 33 passes outside easily. This also helps to prevent current leaks.

Similarly the inclined surface 37, which slopes towards the accommodation space 35*c* toward its lower end, is formed in the vicinity of the surface of the partitioning wall 34*b* at the side of the housing 35*b*, so that water or the like flowing from above along the surface of the partitioning wall 34*b* at the side of the housing space 35*b* passes easily to the accommodation space 35*c*. That is, the water or the like tends not to collect in the housing space 35*b*. This also assists in avoiding current leak between the terminals 17*a*, 17*b*.

Figure 5:
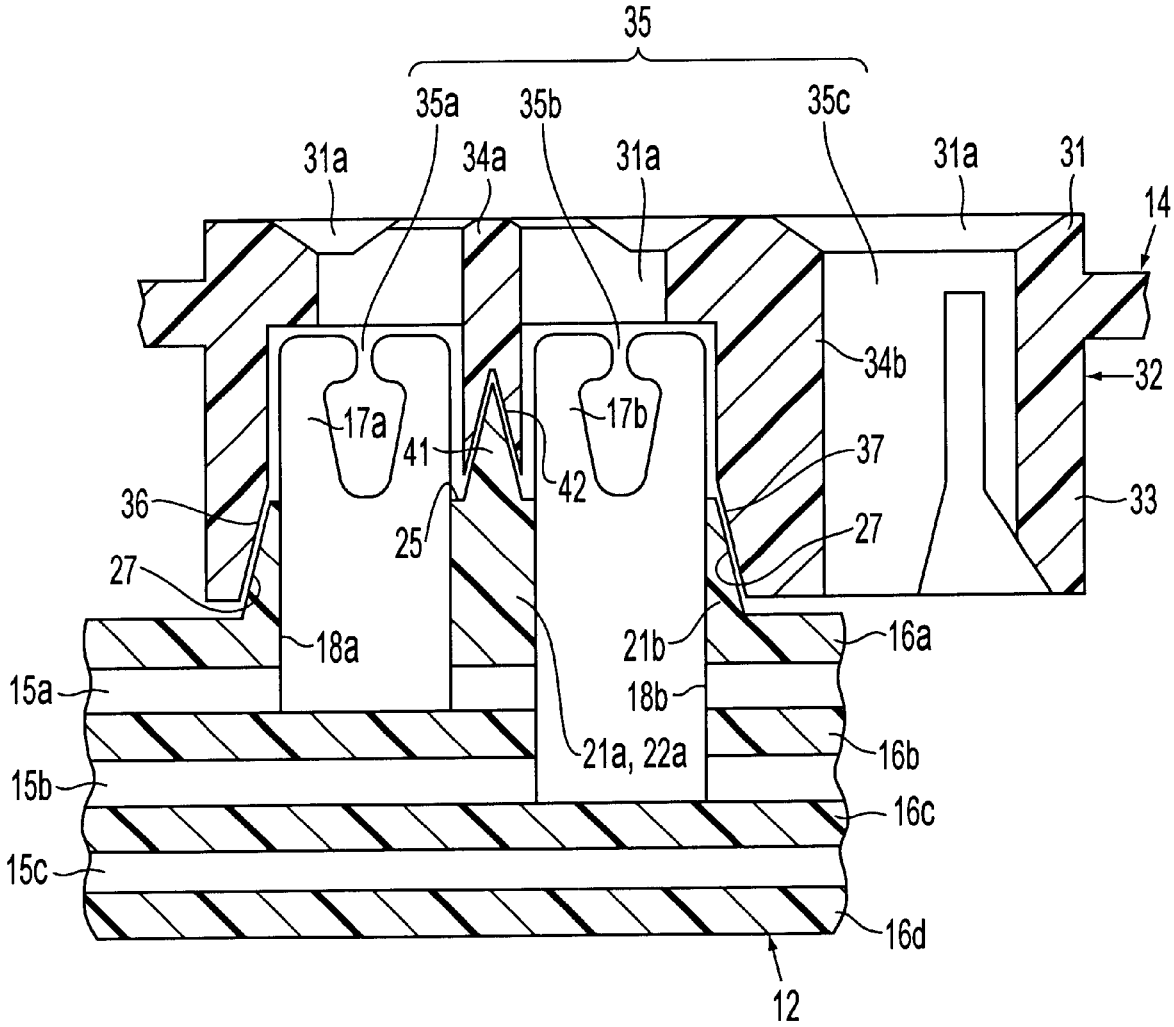
FIG. 5 is a sectional view showing a part of an electrical connection box which is another embodiment of the present invention.

This embodiment of the present invention may be altered, for example as follows:

As shown in FIG. 5, instead of the groove 26 and downward projection, an upwardly tapering ridge 41 may be formed on the upper end surface 25 of the wall construction 21*a*, 22*a* and a corresponding groove 42 formed on the lower end of the partitioning wall 34*a*. It is desirable to form the ridge 41 and groove 42 in such a way that they make surface contact. Thereby, even if water or the like penetrates into the gap between the partitioning wall 34*a* and the side walls 21*a*, 22*a*, the ridge 41 helps to prevent the flow of the water. Thus it is difficult for the water to penetrate this gap, and thereby risk of current leak between the terminals 17*a*, 17*b* is minimised.

In this embodiment, the groove 26 has an inclination. Instead the groove 26 may be formed so that it makes a surface contact all along its length with the lower end of the partitioning wall 34*a*. This construction forms an elongated path between the spaces 35*a*, 35*b* and increases contact of the wall 34*a* and the side walls 21*a*, 22*a*.

It is possible to omit the formation of the inclined surface 36 formed on the outer side wall 33 or the inclined surface 37 formed on the partitioning wall 34*b*.

The electrical connection box may be used for an industrial robot or the like, as well as a vehicle.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. An electrical connection box comprising:

a plurality of bus bars providing at least two upstanding terminals close to each other, an insulation plate overlying said bus bars and having respective apertures through which said terminals project and further having at least one upstanding wall adjacent to said apertures and having an upper end, a case member covering said insulation plate and having walls providing respective housing spaces for said terminals including a partitioning wall separating an adjacent pair of said housing spaces, wherein said partitioning wall has a lower end in contact with said upper end of said upstanding wall, and one of said lower end of said partitioning wall and said upper end of said upstanding wall has a recess and the other thereof has a projection received in said recess.

2. An electrical connection box as claimed in claim 1, wherein said recess is an elongate groove of tapered cross-section and said projection is an elongate ridge of tapered cross-section.

3. An electrical connection box as claimed in claim 2, wherein said groove is at said upper end of said upstanding wall.

4. An electrical connection box as claimed in claim 3, wherein said groove has a base which is inclined horizontally along the groove.

5. An electrical connection box as claimed in claim 1, wherein said recess is on said lower end of said partitioning wall and said projection is on said upper end of said upstanding wall.

6. A vehicle with an electrical connection box mounted on it comprising:

a plurality of bus bars providing at least two upstanding terminals close to each other, an insulation plate overlying said bus bars and having respective apertures through which said terminals project and further having at least one upstanding wall adjacent said apertures and having an upper end, a case member covering said insulation plate and having walls providing respective housing spaces for said terminals including a partitioning wall separating an adjacent pair of said housing spaces, wherein said partitioning wall has a lower end in contact with said upper end of said upstanding wall and one of said lower end of said partitioning wall and said upper end of said upstanding wall has a recess and the other thereof has a projection received in said recess.

7. A vehicle as claimed in claim 6, wherein said recess is an elongate groove of tapering cross-section and said projection is an elongate ridge of tapering cross-section.

8. A vehicle as claimed in claim 7, wherein said groove is at said upper end of said upstanding wall.

9. A vehicle as claimed in claim 8, wherein said groove has a base which is inclined to the horizontally along the groove.

10. A vehicle as claimed in claim 6, wherein said recess is on said lower end of said partitioning wall and said projection is on said upper end of said upstanding wall.

11. A robot with an electrical connection box mounted on it comprising:

a plurality of bus bars providing at least two upstanding terminals close to each other, an insulation plate overlying said bus bars and having respective apertures through which said terminals project and further having at least one upstanding wall adjacent said apertures and having an upper end, a case member covering said insulation plate and having walls providing respective housing spaces for said terminals including a partitioning wall separating an adjacent pair of said housing spaces, wherein said partitioning wall has a lower end in contact with said upper end of said upstanding wall and one of said lower end of said partitioning wall and said upper end of said upstanding wall has a recess and the other thereof has a projection received in said recess.

12. A robot as claimed in claim 11, wherein said recess is an elongate groove of tapering cross-section and said projection is an elongate ridge of tapering cross-section.

13. A robot as claimed in claim 12, wherein said groove is at said upper end of said upstanding wall.

14. A robot as claimed in claim 13, wherein said groove has a base which is inclined to the horizontally along the groove.

15. A robot as claimed in claim 11, wherein said recess is on said lower end of said partitioning wall and said projection is on said upper end of said upstanding wall.

* * * * *